United States Patent [19]

Goodchild

[11] 4,357,691

[45] Nov. 2, 1982

[54] RECTANGULAR-FACED CLOCK

[76] Inventor: James Goodchild, 109B Hill St., Garnethill, Glasgow, G3 6TY, Scotland

[21] Appl. No.: 181,349

[22] Filed: Aug. 26, 1980

[30] Foreign Application Priority Data

Sep. 1, 1979 [GB] United Kingdom ..... 7930370

[51] Int. Cl.[3] ..... G04B 19/20

[52] U.S. Cl. ..... 368/62; 368/78; 368/223

[58] Field of Search ..... 368/223, 232, 233, 234, 368/235, 25, 26, 27, 39, 40, 76, 77, 78, 82, 83, 239, 241, 67, 80, 228, 62, 79; 116/281–283, 299; 40/107, 117, 118, 470–472, 518, 524

[56] References Cited

U.S. PATENT DOCUMENTS

| | | | |
|---|---|---|---|
| 994,122 | 6/1911 | Cassity | 368/40 |
| 2,072,457 | 3/1937 | Larrabee | 368/78 X |
| 2,243,343 | 5/1941 | Johnson | 368/228 |
| 2,757,508 | 8/1956 | Lanetti | 368/235 |
| 3,979,898 | 9/1976 | Werres | 368/78 |

*Primary Examiner*—Vit W. Miska

*Attorney, Agent, or Firm*—Mason, Fenwick & Lawrence

[57] ABSTRACT

A rectangular-faced clock is provided wherein the passage of time is indicated by the intersection of a horizontal and vertical lines moving respectively vertically and horizontally across the front of the clock. The movement of one line relative to the other and vice versa respectively represent the passage of hours and minutes. A convenient means of achieving this result is to mark the lines on endless bands trained about rollers driven by a synchronous electric motor or motors.

4 Claims, 1 Drawing Figure

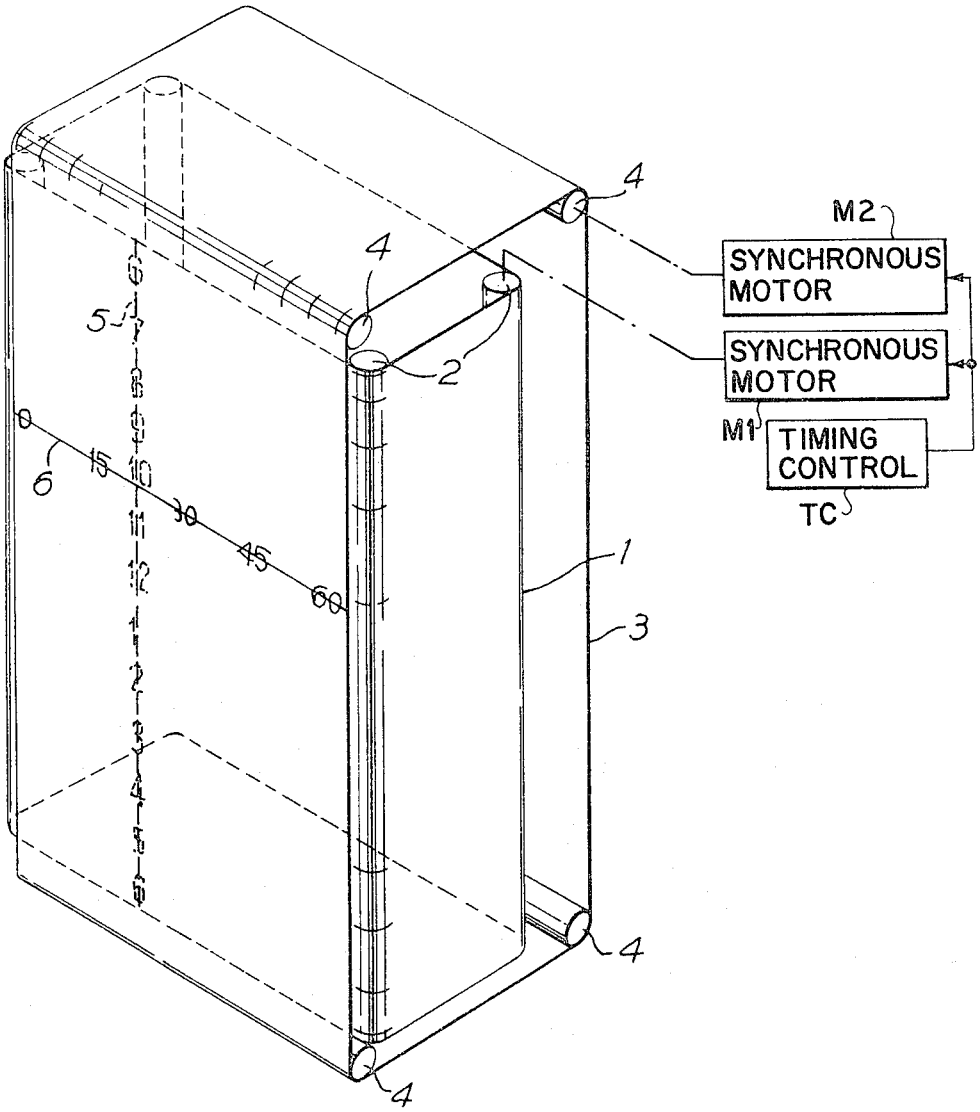
4
4
M2
SYNCHRONOUS MOTOR
SYNCHRONOUS MOTOR
M1
TIMING CONTROL
TC
5
2
6
0
15
30
45
60
1
3
4
4

RECTANGULAR-FACED CLOCK

DESCRIPTION

This invention relates to a rectangular-faced clock.

According to the invention there is provided a rectangular faced clock wherein the passage of time is indicated by the intersection of a horizontal line moving vertically across the front of the clock and a vertical line moving horizontally across the front of the clock, the movement of one line relative to the other line representing the passage of hours and the movement of the other line relative to the one line representing the passage of minutes.

An embodiment of the invention will now be described by way of example, with reference to the accompanying schematic drawing of a rectangular faced clock.

In the drawing an endless transparent band 1 is movable horizontally about vertical rollers 2 and another endless transparent band 3 is movable vertically about horizontal rollers 4. A vertical line 5 is shown on the front of the band 1 and a horizontal line 6 is shown on the front of the band 3, the lines 5 and 6 intersecting each other. A rectangular bezel (not shown) frames the front of the bands 1 and 3 and forms the front of a casing (not shown) housing the bands and the rollers. The line 5 is graduated with the numbers, 6, 7, 8, 9, 10, 11, 12, 1, 2, 3, 4, 5, and 6 from top to bottom and the line 6 is graduated with the number 0 to 60 in desired intervals of 15 or 5.

Electrical synchronous motors M1 and M2 are activated from a timing source such as timing control TC to drive one or more of the rollers 2 and 4 respectively to move the bands 1 and 3 so that the line 5 traverses on band 1 the front of the clock from left to right in one hour and the line 6 on band 3 traverses the front of the clock from top to bottom in twelve hours. The driving rollers may be provided with sprocket teeth engaging in perforations in the edges of the bands. The lines 5 and 6 are repeated along the respective bands so that as one disappears from one side another one appears at the opposite side. Conveniently, the bands 1 and 3 are each of a length that there are three or four lines 5 and 6 on the respective bands. By means of the intersection of the lines 5 and 6 and the graduations thereon the passage of time can be indicated and read with ease. In the relative positions of the lines 5 and 6 in the drawing a time of 10:22 o'clock is indicated.

The embodiment as described and illustrated may be modified in a number of ways. For example, the graduations may be on a fixed part of the clock adjacent to or on the bezel. Also, the horizontal line 6 could instead travel up the front of the clock. In order to indicate the passage of seconds a third band may be provided travelling at a suitable speed either vertically or horizontally across the front of the clock and provided with respectively a horizontal or vertical line repeated as with the other bands. The passage of second may also be indicated by the interaction of lines or dots on the bands and a fixed transparent face of the clock to produce changing interference or "moire" patterns. A similar effect may be produced by differently coloured patches on the bands and fixed transparent face. It is also possible to use such means for exhibiting changing publicity matter.

The front of the clock may be illuminated from within by fluorescent tubes or other illuminant or an image of the clock front may be projected onto a light-reflecting or transmitting surface.

Instead of producing directly the images of the horizontal and vertical lines at the front of the casing by portions of the bands located at the front of the casing, images of the front of the bands carrying the vertical and horizontal lines and the associated numerals may be optically imaged onto an image producing surface at the front of the clock casing by a conventional optical projection system. Alternatively, instead of the moving intersecting lines being marked on moving bands they may be produced electronically by providing the front of the clock with an array of light-emitting-diodes suitably programmed, or by other methods.

I claim:

1. A rectangular-faced clock wherein the passage of time is indicated by the intersection of a horizontal line moving vertically across the front of the clock and vertical line moving horizontally across the front of the clock, comprising a rectangular clock face, first and second time line means for producing at said clock face a horizontal line image and a vertical line image respectively spanning the clock face with the lines intersecting each other, and means for activating said first and second time line means to move said horizontal line vertically and said vertical line horizontally whereby the movement of one line relative to the other line represents the passage of hours and the movement of the other line relative to the one line represents the passage of minutes.

2. A clock according to claim 1, wherein said first and second time line means comprise an endless band trained about rollers rotatable about a horizontal axis and having a horizontal line marked thereon and an endless band trained about rollers rotatable about vertical axes and having a vertical line thereon respectively forming said horizontal and vertical line images and wherein movement of the lines marked on the endless bands trained about the rollers is produced by synchronous electric motor means coupled to said rollers.

3. A clock according to claim 2, wherein graduations representing hours and minutes are also marked on the bands at the respective lines.

4. A clock according to claim 2, wherein images of graduations representing hours and minutes are provided at the front of the clock adjacent the images of the moving lines.

* * * * *